US009243397B2

(12) United States Patent
Mueller

(10) Patent No.: US 9,243,397 B2
(45) Date of Patent: Jan. 26, 2016

(54) METHOD FOR THE CONTINUOUS PRODUCTION OF COMPOSITE FORMWORK PANEL ELEMENTS

(75) Inventor: Michael Mueller, Leopoldsdorf (AT)

(73) Assignee: VST Building Technologies AG, Leopoldsdorf (AT)

( * ) Notice: Subject to any disclaimer, the term of this patent is extended or adjusted under 35 U.S.C. 154(b) by 323 days.

(21) Appl. No.: 14/002,449

(22) PCT Filed: Mar. 2, 2011

(86) PCT No.: PCT/EP2011/053118

§ 371 (c)(1),
(2), (4) Date: Aug. 30, 2013

(87) PCT Pub. No.: WO2012/116745

PCT Pub. Date: Sep. 7, 2012

(65) Prior Publication Data

US 2013/0333192 A1 Dec. 19, 2013

(51) Int. Cl.

| | |
|---|---|
| ***E04B 1/10*** | (2006.01) |
| ***E04B 1/16*** | (2006.01) |
| *E04B 2/86* | (2006.01) |

(52) U.S. Cl.

CPC . *E04B 1/16* (2013.01); *E04B 1/161* (2013.01); *E04B 2/8635* (2013.01); *Y10T 29/49831* (2015.01)

(58) Field of Classification Search

CPC ..... E04B 1/16; E04B 1/161; E04B 2/8635; E04B 1/61; E04B 1/6108; E04B 1/612; E04B 2/86; Y10T 29/49831; C09J 5/00

See application file for complete search history.

(56) References Cited

U.S. PATENT DOCUMENTS

| | | | | |
|---|---|---|---|---|
| 4,709,899 | A | 12/1987 | Kajioka et al. | |
| 2008/0019345 | A1 | 1/2008 | Wu et al. | |
| 2008/0104906 | A1* | 5/2008 | Pyo | B28B 5/028 52/223.7 |
| 2015/0167295 | A1* | 6/2015 | Baader | E04B 2/8635 249/40 |

FOREIGN PATENT DOCUMENTS

| | | |
|---|---|---|
| CN | 86107528 | 7/1987 |
| DE | 19718111 | 12/1998 |

(Continued)

OTHER PUBLICATIONS

English Translation of Search Report from Patent Office of People's Republic of China issued in correlating Chinese Application 201180068917X.

English translation of the International Search Report issued in PCT/EP2011/053118 dated Nov. 22, 2011.

*Primary Examiner* — David Bryant

*Assistant Examiner* — Jun Yoo

(74) *Attorney, Agent, or Firm* — Alexander R. Schlee; Schlee IP International, P.C.

(57) ABSTRACT

A method for the continuous production of panel elements for the production of composite shuttering elements, of which each panel element has a shuttering panel of predetermined geometry with predetermined length. The shuttering panel is provided with fastening devices and reinforcement elements. According to the method a plurality of standard panels are lined-up abutting along their longitudinal edges against each other and being joined and glued together with the application of a pressing force. A panel band is created from the glued-together standard panels. Individual longitudinal portions are successively separated from the panel band, resulting in individual panels. The individual panels are successively cut to form the respectively individually predetermined geometries of the respective shuttering panel and are then successively provided with the fastening devices and then with the reinforcement elements.

11 Claims, 4 Drawing Sheets

(56) References Cited

FOREIGN PATENT DOCUMENTS

| | | |
|---|---|---|
| DE | 69231807 | 10/2001 |
| DE | 102005038338 | 2/2007 |
| DE | 102005044462 | 3/2007 |
| DE | 102005044462 | 1/2008 |
| DE | 102006044462 | 1/2008 |
| EP | 0611852 | 8/1994 |
| EP | 0811731 | 12/1997 |
| WO | 93/12918 | 7/1993 |
| WO | 2007012345 | 7/2005 |

* cited by examiner

METHOD FOR THE CONTINUOUS PRODUCTION OF COMPOSITE FORMWORK PANEL ELEMENTS

CROSS REFERENCE TO RELATED APPLICATION

This application is a national phase of the International Application PCT/EP2011/053118 filed Mar. 2, 2011. The content of this aforementioned document is herewith incorporated by reference.

TECHNICAL FIELD OF THE INVENTION

The invention relates to a method for the continuous production of panel elements for the production of composite shuttering elements in form of ceiling elements or wall elements which are used in the field of building construction for erecting buildings. Each panel element comprises a shuttering panel that is equipped with fastening devices and reinforcement elements. Each shuttering panel has a specifically predetermined length and a specifically predetermined geometry.

The composite shuttering element can be a ceiling element or a wall element. The ceiling element can be, as for example known from EP 811 731 A1 or EP 1 907 642 B1 and seen from FIG. 2, a panel element with a shuttering panel 2 that is preferably equipped with screwed-on fastening devices 6, e.g. in form of stirrups for fastening reinforcement elements 5, and with the reinforcement elements. The wall element can be composed, as for example known from EP 611 852 A1 or EP 1 907 642 B1 or seen from FIG. 1 or FIG. 2, of two panel elements with respectively one shuttering panel 1, 2 that each are equipped with a plurality of, preferably screwed-on, fastening devices 3, 4 in form of wall coupling elements and with reinforcement elements 5. The two panel elements 1, 2 are turned towards each other with their fastening devices 3, 4 and reinforcement elements 5 and their shuttering panels 1, 2 are held in a distance from one another at by the fastening devices 3, 4.

BACKGROUND OF THE INVENTION

With help of such composite shuttering elements wall and ceiling structures can be erected in coated-concrete-massive-construction-technique, in which the shuttering elements in prefabricated shape, preferably of cement-bound flat hardboards, remain as a so called lost shuttering in the structure work. Such a construction method in composite shuttering technique does not only meet every creative or technical requirement with high flexibility, but also achieves high ecological and economical standards.

The composite shuttering wall element is composed of two panel elements with, for example 24 mm thick shuttering panels in form of cement-bound flat hardboards, which are industrially joined at the production facility to hollow, two-shelled wall elements. For stabilizing the form and for holding the shuttering pressure fastening devices are preferably used which are screwed from the inside, in form of steel profiles as so called "wall couplers". The wall elements are erected dimensionally accurate on the building site and are poured in with flowing concrete or self-consolidating concrete (SSC). The surface forming cement-bound flat hardboards are on their part to be provided with flawless a surface. As coupling elements preferably steel spacers are used which are screwed to the shuttering panels by zinc coated countersunk screws. They connect the panel elements from the inside without penetration of the outer surface of the shuttering panels. All wall elements are readily prefabricated produced and their shuttering panels are provided with all necessary apertures and with the necessary transport anchors as well as with the necessary reinforcement (mats, cages, etc.) that correspond to the static calculation.

Conventionally, the usual product dimensions for most of the wall elements to be produced require that those have to be assembled longitudinally from sub-elements. The maximum length of the sub-elements complies with the maximum length of the raw material—the cement-bound flat hardboards. The production process of such composite shuttering elements according to the prior art is, for example, carried out as described consecutively:

Cutting the cement-bound flat hardboards to the predetermined size of sub-shuttering-panels on a panel saw, as far as the predetermined size of the sub-shuttering-panel to be produced differs from the dimensions of the raw material. Manual screwing of coupling ledges, which serve for the fastening of the wall coupling elements, onto the sub-shuttering-panels of the first shuttering panel at predefined positions.

Manual screwing of the wall coupling elements on the sub-shuttering-panels of the second shuttering panel at predefined positions. The wall coupling elements serve for mutual coupling of the two shuttering panels of the sub-elements in a subsequent processing step.

Manual attaching of coupling ledges for the coupling of multiple sub-panel-elements to a total panel-element.

Manual boring of apertures for electrical installation work.

Manual installing of the required mat reinforcement for the total panel-element, inclusive of the required overlap reinforcement for the statically effective coupling of the reinforcement of the sub-panel-elements.

Manual installing of the electrical installation like electrical sockets and ductworks.

Manual installing of lifting anchors for the lifting of the assembled total panel-elements by crane for the following processing steps in the factory and on the building site.

Assembling the first and the second sub-shuttering-panel of the sub-panel-elements on a manually operated joining station (pressing).

Manual assembling the sub-panel-elements to produce the finished composite shuttering wall element.

Manual completion of the wall element by installation of intrados panels at window and door cavities.

SUMMARY OF THE INVENTION

For rationalizing the production capacities due to rising demand, there is necessity to create an as far as possible automated production line for production of composite shuttering elements. Such a production line concerns a chaining of multiple machines/facilities for producing individual parts (particularly composite shuttering panel elements in form of associated pairs of panel elements for producing wall elements, but also in form of panel elements as composite shuttering ceiling elements, respectively in predetermined size and geometry). For coordination and logistical controlling the facility, a central control system is to be applied. The advantages of modern industrial fabrication in a hall are in a higher efficiency of the working hour due to optimized work sequences and the possibility to have a high capacity utilization of the production facilities.

By the present invention, a method is created by which a continuous, at least as far as possible automated production of panel elements of the aforementioned type in predetermined sizes and in predetermined geometries can be achieved, wherein the sizes as well as the geometries of the intended panel elements for the shuttering elements can be individually adapted to the predetermined dimension and geometry for every panel element.

According to the present invention, a plurality of standard panels, particularly cement-bound flat hardboards, are lined-up longitudinal edge to longitudinal edge and are in sequence subsequently joined and glued together while applying a pressing force. The row is conveyed away in its longitudinal direction, and hence in transverse direction of the standard panels. By the joining and gluing, a continuously connected panel band is generated that is moved forward in the conveying direction, particularly moved forward stepwise. From the moved-forward panel band, successively individual longitudinal sections are separated in the respectively predetermined length of the shuttering panel currently to be produced.

The separation of the longitudinal sections is carried out along a parting line that continues transversely, preferably perpendicular, to the moving direction of the panel band, and hence transversely to the two side edges of the panel band. Hence, by this separating, successively individual panels are generated, of which each individual panel includes two side edges, that are opposite to each other, correspondingly transversely to the moving direction, and therefore are formed of longitudinal sections of the two side edges of the panel band. Each of the individual panels has a length which is adapted to the respective predetermined length of the shuttering panel to be produced and preferably is in conformity with this predetermined length.

The individual panels are conveyed in their longitudinal direction. The lengths of the successive separated individual panels can match with each other. Alternatively the lengths of the successive separated individual panels can differ, when the predetermined lengths of the current successive shuttering panels, which are to be produced, differ. For the production of panel elements, which should be erected as composite shuttering elements and therefore comprise two shuttering panels held at a distance, the two shuttering panels are preferably produced from a pair of successively separated individual panels. Therefore, these have identical or different lengths that are measured in the direction of movement of the panel band.

According the invention, the respective length of each individual panel can be selected freely, because this length is independent of the respective length of the standard panels by the separation of the individual panel from a panel band that is produced continuously, and so to say of "endlessly", by the preceding lining-up and gluing of the standard panels. The respective width of the panel band is rather determined by the respective length of the standard panels. Therefore, even long composite shuttering elements can preferably be produced by the invention, without that these have to be assembled subsequently from sub-elements.

After the separation of the individual panels, these are processed for developing the predetermined geometry of the respective shuttering panel, preferably for developing the predetermined width that corresponds, for the production of a composite shuttering element, to the respective heights of the shuttering panel of the wall element, and are processed for developing all intended apertures. The respectively predetermined widths of the two shuttering panels of a wall element can be identical or be different. For example, the respective shuttering panel, that is intended to be located at the building site on an inner side of the building, can be provided, for the connection of a ceiling element, with a smaller width and therefore height at the erected wall element. The shuttering panel suchlike processed can then be individually equipped with fastening devices, which preferably serve as wall coupling elements or spacers and/or reinforcement elements, and can afterward also be equipped individually with the respectively required reinforcement elements.

The standard panels can be extracted individually, in a extracting station, from a supply and conveyed in their longitudinal direction successively through an edge processing station and through a glue applying station. Subsequent thereto, the standard panels can be transferred onto a main conveyor line whose conveying direction is transversely, preferably perpendicular, to the longitudinal direction of the standard panels and on which the standard panels are lined-up successively. The further processing can be performed in individual working stations, which are successively following each other along the main conveying direction. Thus, in a pressing station, the joining and gluing of the standard panels can be performed, preferably in predetermined pressing steps. For this, the panel band is preferably discontinuously or intermittently moved forward, that is performed in a pause of movement intermediate of two movement steps.

A separating station can follow the pressing station, in which the individual separating of the respectively forward moving longitudinal portion of the panel band is performed for forming the respective individual panel, which is in its length individually adapted to the respectively shuttering panel to be produced out of the individual panel. The separating also preferably occurs in standstill of the panel band, wherefore a pause of movement of the panel band during a pressing step is preferably exploited.

A working station can follow to the separating station, in which the processing of the individual panel by the individual cutting of the same is performed, and which in its turn is followed by a fastening station, in which the fastening devices are fastened, preferably screwed, at predetermined locations of the shuttering panel. Subsequent to the fastening station one or more reinforcement stations can follow, in which reinforcement elements, which are individually adapted for their respective requirements, like reinforcement mats or reinforcement cages, can be mounted. Further working stations, which can be provided as manual working stations, can follow. At the end of the main conveying line a tilting station can be provided, in which the finished panel elements can be erected for the transport into an interim storage, if these panel elements are intended for erecting a wall element. Such panel elements, however, that are intended as ceiling elements and have been processed as ceiling elements, can be transported in a lying manner—without being tilted.

The conveying of the panels through the individual working stations is preferably carried out, at least until into the fastening station, in longitudinal direction of the individual panels and preferably discontinuously, so that the individual working steps are performed in the standstill of the respective panel. The cycle times in single successive working stations corresponding to the respective processing duration can be adapted to one another, so that the respective processing like the joining and gluing of the lined-up standard panels in the pressing station and the respective separating of the individual panels in the separating station can be performed there at the same time. The respective cycle times in the working stations following the separating stations however can be uncoupled from each other so as to optimize the overall throughput time.

In particular, according to the invention, the respective cycle time in the working station can thereby be uncoupled from the separating station and the pressing station, that the separated individual panels are stacked successively from top to bottom one upon the other at a location intermediate between the separating station and the pressing station in a buffer stack and are extracted from the buffer stack successively from below and are transferred into the processing station. Hereby, the processing station can be located at a lower level than the separating station. The individual panels are conveyed in the buffer stack—in adaption to the respective processing duration in the processing station—discontinuously downwards. The processing durations of the individual panels in the processing station are in their turn dependent on the extent of the respective cutting works, which can be different according to the projected final geometry of the shuttering panel, for example for their location at an outer side of the wall or an inner side of a wall. By the intermediate stacking of the individual panels before the working station, however, a longer processing time in the working station at the one individual panel can be as far as possible be compensated by a shorter processing time of a successive individual panel.

Likewise intermediate between the working station and the fastening station a buffer stack can be provided, in which the seized shuttering panels can be stacked from bottom to top one below the other and also conveyed temporal discontinuously upward again, preferably to a higher working level of the fastening station. Thereby, different processing times in the processing station can additionally be compensated.

A further uncoupling of working times can be achieved in particular for the reinforcement stations by branching the main conveyor line, so that at the conveyor branches a simultaneous processing of a plurality of panels can be performed and also manual working stations along the conveyor line can be incorporated in the fabrication.

For the production of a wall element, two individual panels, which are preferably transferred successively into the processing station, are alternatingly seized as an inner shuttering panel or an outer shuttering panel. These two shuttering panels should be turned, in the finished composite shuttering wall element, with those sides toward each other, which have been their upper sides during processing. Their cutting is preferably carried out in dependency on, that the one side edge of the one individual panel is defined as a foot portion of the shuttering panel that is generated from this individual panel, and that the other side edge of the other individual panel, that is turned away from the said other side edge, is defined as a foot portion of the other shuttering panel that is generated from the said other individual panel.

Thereby, these two shuttering panels can be erected in the tilting station, which is provided at the end of the conveyor line, around their respective foot portion in opposite tilting directions such, that the upper side of the one shuttering panel faces in a direction that is opposite to the direction in which the upper side of the other shuttering panel faces. When furthermore the one shuttering panel is displaced sideward in a direction before or in the tilting station that is turned away from their foot portion, and the other shuttering panel is disposed next to the first shuttering panel such, that the foot portions of the two shuttering panels are turned towards to each other, the two shuttering panels can be folded up like a book for their erection in that alignment that they take in the finished wall element.

Subsequent to the separating, the individual panels are preferably mounted on transport pallets and are conveyed on the same into the tilting station. A recirculation conveyor line can be provided for the transport pallets, on which the pallets are conveyed back in a position behind the separating station and are then fed again onto the main conveyor line.

In the following, the invention is described further on the basis of the description of a preferred embodiment and on the basis of the figures.

DETAILED DESCRIPTION OF THE DRAWINGS

Figure 1:
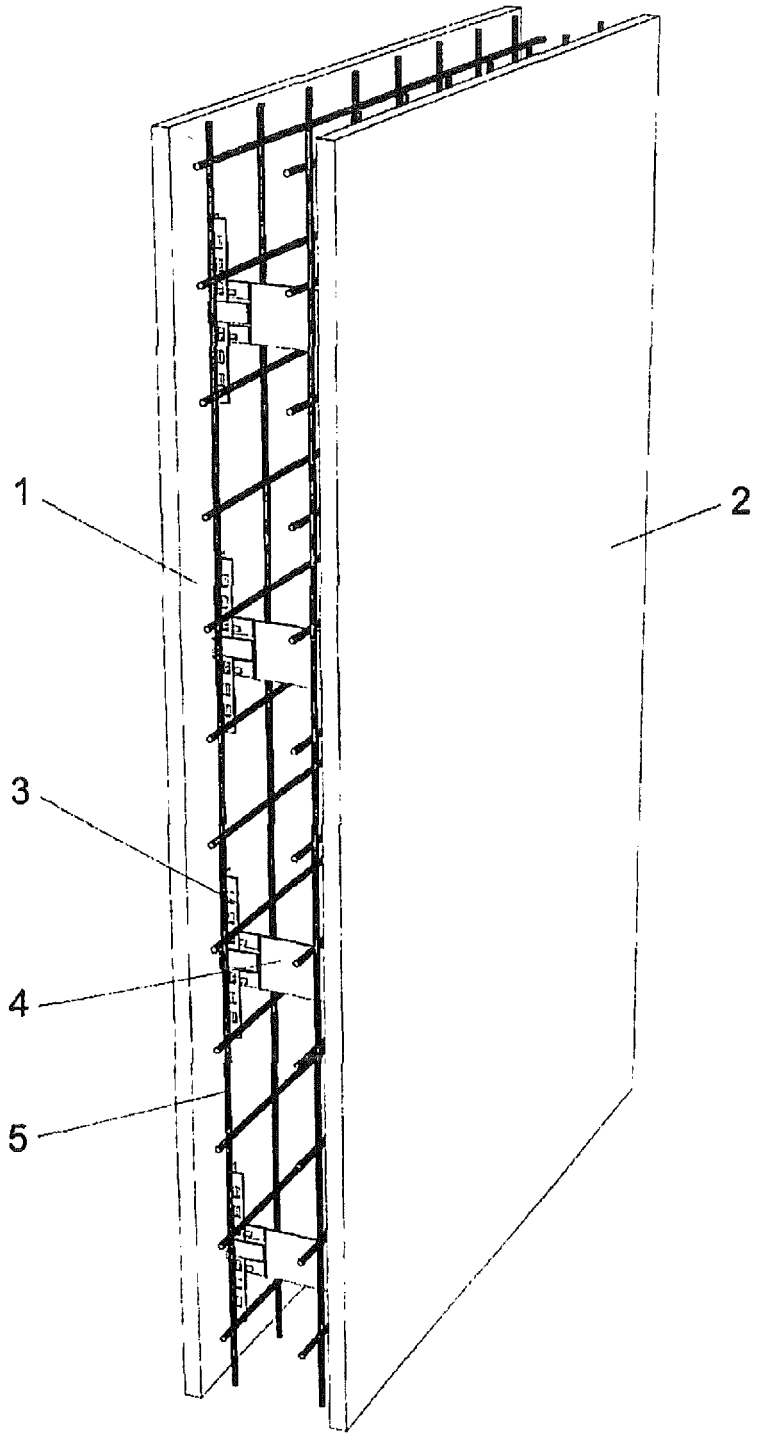
in FIG. 1 a schematic perspective-view of a composite shuttering wall element, in FIG. 2 a schematic perspective-view of a composite shuttering ceiling element in T-joint with a composite shuttering wall element, in FIG. 3 a schematic layout of a facility for the execution of a method according to the invention, and in FIG. 4 a schematic part-side-view of the facility from FIG. 3 in the area of the processing station.

Description of to a Large Extent Automated Method According to the Invention for the Production of Panel Elements for Producing Composite Shuttering Elements

REFERENCE NUMBERS OF THE COMPONENTS

1 Outer wall shuttering panel
2 Inner wall shuttering panel
3 Wall coupling element
4 Wall coupling element
5 Mat reinforcement
6 Mat hook
7 Mass concrete, filled in after erecting the wall elements on the building site
11 Standard panel
12 Panel band
13 Individual panel
13A Foot portion of the shuttering panel
13B Foot portion of the shuttering panel
20 Automated extracting station for standard panels
21 De-stacking spaces for standard panels
22 Feeding conveyor system for standard panels
23 Measuring device
24 Edge processing
25 Cleaning device
26 Glue applying station
27 Main conveyor belt
28 Pressing station
29 Processing station
30 Separating station with mobile saw
31 Recirculation of pallets
32 Transport pallet
33 Buffer stacking device
34 Buffer stacking device
35 Fastening station
36 Feeder transport units
37 Recirculation and reinforcement stations
38 Working and reinforcement stations
39 Mat welding facility
40 Working and tilting stations
41 Recirculation conveyor line for transport pallets
42 Vertical working stations
43 Joining station In contrast to a conventional production process, the raw material, the cement bound flat hardboards (hereinafter referred to as standard panels 11), is processed into a moved-forward panel band 12, from which the individual panels 13 are successively separated. The individual panels 13 provide a sufficient size so as to produce thereof in one piece the composite shuttering ceiling elements, composed of one panel element, or the composite shuttering wall elements, comprising their two panel elements with their wall shells 1 and 2. Therefore, the production of sub-elements and the subsequent assembling of the wall elements from sub-elements are eliminated.

Production of a Panel Band from the Standard Panels

The standard panels 11 are delivered on pallets. The standard panels are inserted by a hall crane from their repository in an automated extracting station 20. This extracting station comprises in this example 2×2 de-stacking spaces 21, which are safeguarded to another with fences and light barriers in such a manner that a safe loading and unloading on the one de-stacking space while undisturbed extracting from the second de-stacking space are possible.

From the de-stacking spaces 21, one standard panel 11 is extracted from the stack at a time and applied onto a feeding conveyor system 22. Every de-stacking place is intended for the same or for a different type of length of the standard panels 11. The height of each panel stack is signaled to the control system, that is to say, the warehouse clerks receive an optical and acoustical signal in time when a new pallet with standard panels has to be fed. Applied on the conveyor system the standard panels 11 are guided in their longitudinal direction through a measuring device 23 that is testing the panel regarding to constant thickness. Should a standard panel 11 exceed this value, for example by bended ends ("bowl-type deformation"), production faults or suchlike, so it will be shifted off the conveyor system into a container by a discharge device without further processing. At the same time the measuring device 23 signals the reject to the control system.

Profiling the Standard Panels

After the measuring device 23, the standard panels 11 are automatically guided in their longitudinal direction through an edge processing station 24, in which then, during the passing, groove and tongue are respectively milled into at both longitudinal edges of the standard panel 11. For that purpose, the machine is provided with a feeder device, from which the standard panels are automatically centered and aligned with their longitudinal direction to the conveying direction. Generally three types of edges can be provided:

groove or tongue with chamfer on the outside of the standard panel 11 groove or tongue with chamfer on the outside of the standard panel 11 ("Schwedennut")—standard chamfer: 3 mm groove or tongue with chamfer on the outside of the standard panel 11 ("Schwedennut")—chamfer: 6 mm (V-groove visible)

After the edge processing station for profiling the edge a cleaning device 25 is arranged, which cleans the processed surfaces for the glue application.

Alternatively, a connection of standard panels 11 to a panel band 12 is possible without a preparation of a groove or nut.

Glue Applying

The glue applying station 26 is mounted on one side of the feeding conveyor system 22. Here, the grooves are automatically loaded with glue during their passage. The load quantity is adjusted to the conveyor speed. The milled standard panels 11, that are provided with glue for the pressing, reach immediately after the glue applying station 26 the wider main conveyor belt 27, to which the standard panels are fed with their longitudinal direction perpendicular to the conveying direction of the main conveyor belt and which leads to the pressing station 28 in a direction of production that is perpendicular to the longitudinal direction of the standard panel 11. Here, the withdrawal of the panels in the main conveying direction is accelerated so as not to interrupt the continuous flow on the feeding conveyor system 22.

Pressing

The standard panels 11 are fed one by one into the pressing facility of the pressing station 28 and an "endless"-panel, a panel band 12, piece by piece and longitudinal edge to longitudinal edge, is lined-up, aligned and pressed and thus glued. This working process is carried out in cyclic operation (discontinuously). The accuracy of the panel alignment of the standard panel 11 to each other when aligning and pressing is controlled and, if necessary, an error message is effected (visual and acoustical signal and a message to the control system).

The so steadily newly generated panel band 12, in which the glue joints are aligned perpendicular to the longitudinal direction of the panel band, has immediately after the pressing of the standard panels sufficient stability, so that it can be further processed and moved-forward.

From this so obtained panel band 12, the element geometries of the shuttering panels 1, 2 in the processing station 29 can finally be developed.

Separating Individual Panels from the Panel Band

The panel band 12 is shortened immediately after the pressing of the standard panels 11 into that length that is individually predetermined for each shuttering panel 1, 2 the by the production sequence, so that the individual panels 13 in the respectively predetermined length of the shuttering panels 1, 2 are generated from the separated longitudinal sections of the panel band 12. For this purpose, following the pressing station 28, a separating station 30 with a saw, which is movable in the conveying direction of the panel band 12, or another mobile separator is provided. The cut takes place when the panel band 12 is stationary, that is to say, during the pressing time at the joining of the standard panels 11 in the pressing station 28. The individual presetting of the cutting position is controlled by the control system. This separating device 30 is simultaneously provided with a plotter, which controllably labels, again during the pressing, the individual panels 13 that are generated by the cut.

The following marks are provided:

identification of the elements to be generated in the processing station 29, that is to say, a shuttering panel for a ceiling element or for a wall element, intrados panel, etc., classification of possible built-in parts, e.g. electrical sockets, marking on the respectively provided foot portion of the shuttering panel for a wall element.

Recirculation of Pallets 31 and Processing of the Individual Panels for the Production of Shuttering Panels for Ceiling Elements or Wall Elements:

The recirculation of pallets 31 consists of workpiece carriers 32, so-called transport pallets 32, which contain simple centering devices and contain as the workpiece support an easily replaceable wear grid or wear mandrels for processing in the processing station 29 (for example, water-jet facility or similar cutting installation).

Transport Pallet (Work Piece Carrier):

After trimming the panel band 12 into the individual elements, the individual panels 13, all further process steps now take place on the transport pallets 32. These consist of rolled profiles as edge beams and are equipped with an easily replaceable grid as carrier surface. Centering devices on the edge profiles are provided at the corners, which allow for easy alignment and fixing of the transport pallets 32 in the individual work stations. The transport of the transport pallets 32 takes place, for example by roller blocks and friction wheels, the position detection takes place via end switches.

Loading the Transport Pallets with Individual Panels

After the trimming of the panel band 12 into the corresponding individual panels 13 for the production of the shuttering panels 1, 2 for ceiling elements or wall elements, according to presettings of the control system, the individual panels 13 are then brought in by raisable and lowerable rollers, which can be driven up between the grids of the transport pallets 32, over the transport pallet 32 and are positioned by lowering the rollers under the grid on the transport pallet 32. The individual panels 13 are aligned on the grid by simple alignment units on the transport pallet 32. Then, once the clearing comes from the control, namely the control system, the transport pallets 32 are then driven, preferably in longitudinal direction of the individual panel, into a first stacking position. Here, the transport pallets 32 are raised by means of a special buffer-stacking device 33 and are stacked from top to bottom on each other and are conveyed discontinuously down to a lower processing level (see FIG. 4). Thereby the centering devices of the transport pallets 32 serve for the exact positioning of the transport pallets 32 or as protection against tilting over. This stacking device 33 serves as a temporal buffer.

In the following, the further processing of the individual panels for the production of panel elements for wall elements is described. The further processing of the individual panels for the production of ceiling elements is respectively made in adaption to this purpose.

Processing Station 29 (Water-Jet Cutting)

The next transport pallet 32 from the stacking device 33 with the hereupon lying individual panel 13 is extracted from the stacking device 33 at the bottom and brought in, after a ready indication from the processing station 29, into said processing station in longitudinal direction of the individual panel, and aligned there on the centering cones that are present on the table structure. In the processing station 29, the position of the individual panel 11 and their respective longitudinal side edge, which is the foot portion 13A or 13B of the to be produced shuttering panel 1, 2 in the erected wall element, is checked on the transport pallets 32, and the processing by cutting can eventually be made, adapted to the position.

From the glued individual panel 13, the wall geometries, including all apertures, which are optimized in regard to waste, are generated here. Several small wall panels can be placed on one transport pallet 32. Both shuttering panels 1, 2 of a wall element are always produced in immediate succession. Besides shuttering panels, intrados panels or other special geometries such as stair stringers, etc. are generated of the excess lengths of the clamping, according to the presetting of the control system.

The cutting of the individual panels is also carried out, inter alia, depending on which of the two side edges of the individual panel 13 is provided as respective foot portion of the final outer shuttering panel 1 or inner shuttering panel 2 in the finished wall element. The ready-equipped shuttering panels in the form of panel elements are tilted at the end of the fabrication in a tilting station 40 around their respective foot portions and are thereby erected. In addition, the upper sides of the cut individual panels should be facing each other in the finished wall element after their equipping. Therefore it is preferred, already in the processing station 29, to carry out the cutting of the successive two individual panels 13, which are provided for one and the same wall element, in such a manner that the side edge of the one individual panel 13 is provided as foot portion 13A of the one shuttering panel and the other side edge of the other individual panel 13 is provided as a foot portion 13B of the other shuttering panel. Thereby it can be achieved, that the upper sides of the two panels face each other like in the finished wall element by merely tilting in opposite tilting directions. This will be further explained further down in the description of the tilting station 40.

When the processing by cutting the individual panel 13 into the particular geometry of the respective shuttering panel 1, 2 is completed, the control receives a signal and then, the transport pallet 32 with the already processed individual panel is at the same time driven out into a further buffer stacking device 34 as a transport pallet 32 with the next individual panel is brought in into the processing station from the stacking device 33.

Figure 4:
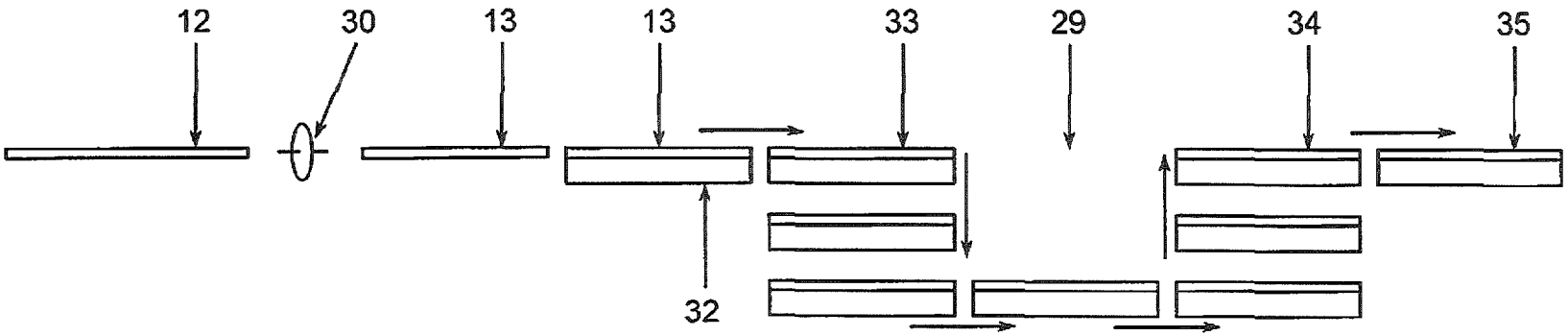

After the processing station 29, a further buffer stacking device 34 is therefore provided with the difference, that here it is stacked from bottom up (see FIG. 4).

Fastening Station 35 (in this Example Screwing Station), Applying the Wall Coupling Elements 3, 4:

The transport pallets 32 from the stacking device 34 are now automatically driven in longitudinal direction of the individual panels into the screwing station, after the ready indication from the screwing station 35, are again centered and processing can take place there.

The wall coupling elements 3, 4 are manufactured separately and applied onto feeder transport units 36, from which the wall coupling elements 3, 4 are then delivered, sorted by sort and type, to the screwing station 35. Thus always continuously, at least one or more wall coupling elements 3, 4 per type should be available in engagement for the screwing station 35.

The robot in the screwing station 35 is provided with both, with specific gripping and setting device(s), which are suitable for wall coupling elements 3, 4, and with a multiple screwing device for fastening the wall coupling elements 3, 4 on the cut individual panels 13. The feeding of the screws is performed automatically.

Figure 2:
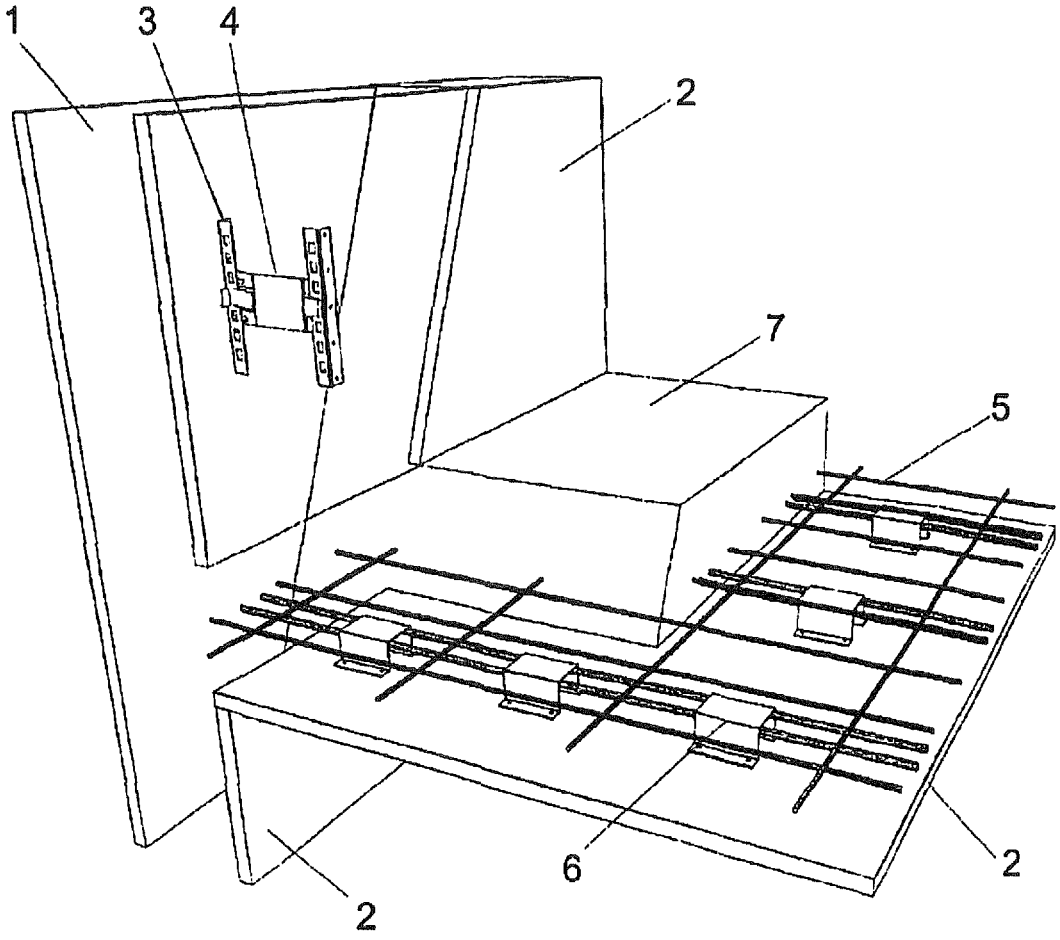
Figure 3:
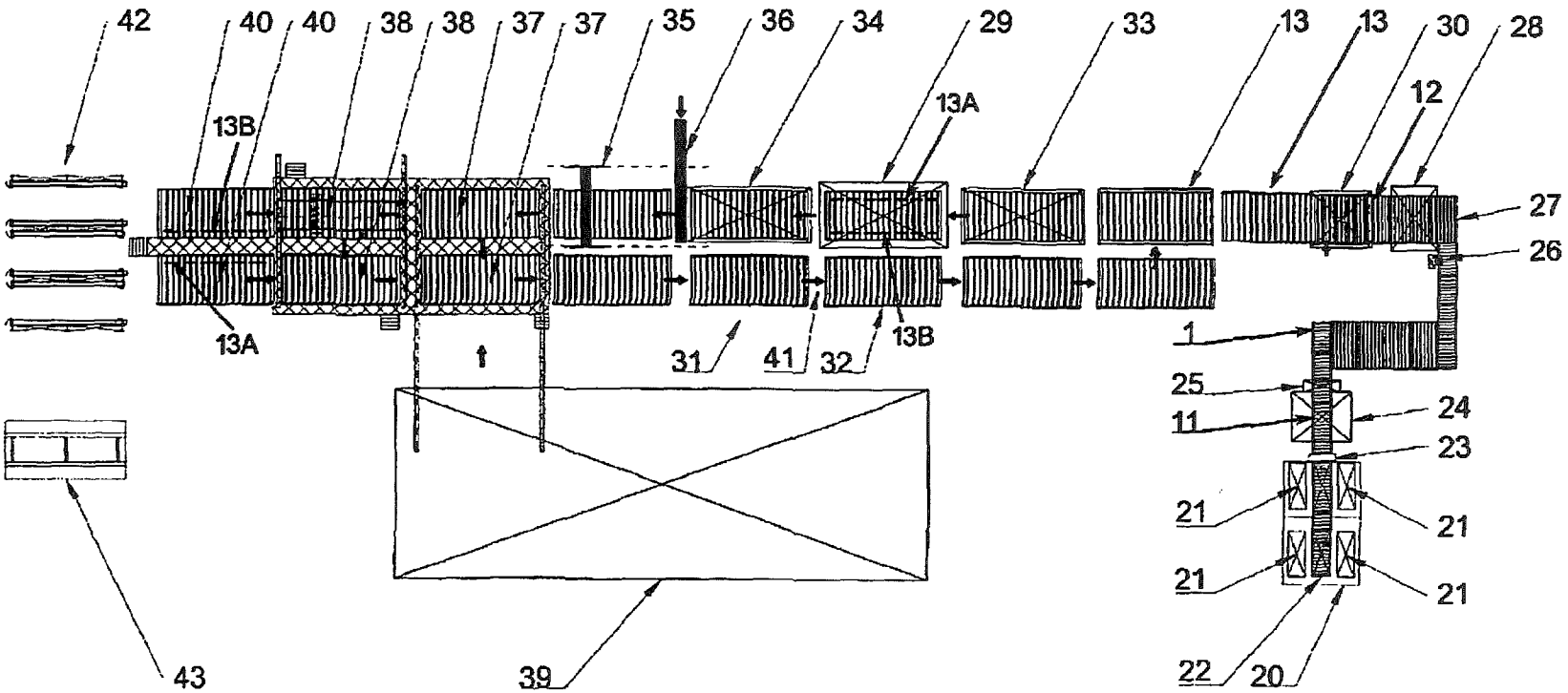

For the production of panel elements, that are provided as ceiling elements, the equipping of fastening elements, which for example—as shown in FIG. 2—are formed as fastening stirrups 6 (FIG. 2) for the reinforcement elements 5, and the screwing of the same are performed accordingly.

After all wall coupling elements 3, 4 are screwed on, the controller receives a signal and now the transport pallet 32 with the processed panel is simultaneously extracted from the fastening station 35 and a transport pallet 32 from the second stacking device 34 is driven in.

Manual Stations:

Subsequent to the fastening station 35, a separation of the transport pallets 32 in one or, however, a plurality of conveyor branches is carried out (in the example two conveyor branches) by laterally displacing, for example every second transport pallet into the second conveyor branch. On the circulation work stations 37, the reinforcement mats 5 are then manually inserted with the help of a handling crane, and, thereafter, the equipped panels are further conveyed in parallel on the transport pallets 32 into the next working station 38. Then, the installation of reinforcement cages is carried out, if statically required so far.

The insertion of the mat reinforcement 5 can also be carried out automatically. The mat reinforcement 5 can be produced by a fully automatic mat welding facility 39 individually for each wall element.

In the next two working stations 38, the cut-outs, which have been produced in the processing station 29, are removed with a light crane with suction-beams and are deposited in containers or boxes. Also the mat reinforcement 5 is supplemented according to the presetting and the lifting anchors are installed.

Action to be Taken at the Working Stations 38:

- screw-on mat hooks 6 (where required)
- attach additional reinforcement
- attach mat reinforcement 5
- attach [translator: "attach" added] spacer mat reinforcement 5 (4 pcs./wall)—otherwise the wall coupling elements 3 act as a support
- attach transport anchors Working and Tilting Stations 40 and Recirculation Line 41 for Empty Transport Pallets 32:

After the manual processing, the transport pallets 32 are conveyed further in longitudinal direction of the panels onto the area above the tilting stations 40. Thereto, the transport pallets 32 are lowered. In the tilting stations 40, the transport pallets 32 are erected by about 80° and the panel elements are appended to the crane beams for the further transportation to the vertical working stations 42 and are taken of in vertical position off the transport pallet 32.

Of the two shuttering panels, which have been cut successively in the processing station 29 for one and the same wall element, the one shuttering panel has been laterally displaced at the branching of the main conveyor line or in the working and recirculation stations 37, 38 in a direction which is turned away from the foot section 13A of this shuttering panel. Thereby, the two shuttering panels are such fed to the two tilting stations 40 in such a manner that they are disposed next to each other there with mutually facing foot portions 13A, 13B. Thereby, these two shuttering panels can be folded around their respective foot portions 13A, 13B like a book in opposite directions and can then be transferred, erected in the relative position which they take in the finished wall element, into the vertical working stations 42 and then into the joining station 43.

After the erecting and transporting the shuttering panels in the tilting stations 40, the now empty transport pallets 32 are pivoted back into the horizontal position and are conveyed back into a position before the stacking device 33. Once arrived between the fastening station 30 and the processing station 29, the empty transport pallets 32 are fed into a position before or in the first stacking device 33, and can so be fitted again with individual panels 13.

The panel elements, which are removed by crane from the tilting stations 40, are completed in so-called vertical working stations 42 in manual working steps and are prepared for the joining (pressing) of the panel elements which comprise the first 1 and the second shuttering panel 2.

The joining together (pressing) of these two panel elements is performed on a manually operated joining station 43.

After the pressing of the two panel elements into a composite shuttering wall element, the wall element is completed by incorporating intrados panels at window and door openings from the blends that were previously stored in the last two working stations 38. The final composite shuttering wall elements are stored into transport frames after possibly required cosmetic finishing steps.

When the panel elements were processed and equipped for the production of ceiling elements, they need not be erected in the tilting stations, but can be removed lying from the respective transport pallet and then be stored.

Advantages of the Production Process:

In contrast to the conventional production process, the cement-bound flat hardboards are processed into a moved-forward panel band 12. The panel band has a sufficient size to produce the shuttering panels 2 for composite shuttering ceiling elements, respectively consisting of a panel element equipped with a for this use reinforced shuttering panel 2 (FIG. 2), or the shuttering panels 1, 2 for composite shuttering wall elements, consisting of their two panel elements with the equipped shuttering panels 1 and 2 (FIG. 1) in a single piece. Thus the production of sub-elements and the subsequent assembling of the ceiling or wall elements of individual sub-elements is eliminated.

In addition, significant material savings by reduced wastage of the raw material, the cement bond flat hardboards, are ensued by the endless processing with the help of the panel band 12, of which the individual panels 13 can be separated individually in the required lengths. More material savings result from the elimination of necessary overlap reinforcements and so-called connecting ledges that must be provided at the conventional assembling the composite shuttering wall elements from the prefabricated sub-elements. Thanks to the almost seamless prefabrication of the shuttering panels, an improved surface quality of the final product results.

Dimensional tolerances of the product are greatly improved because the influences of the tolerances of the sub-elements and inaccuracies in assembling the composite shuttering elements from the sub-elements are eliminated.

The manufacturing expense for composite shuttering wall elements is significantly reduced, since many working steps can run automatically and the planning and manufacturing of sub-elements is eliminated as well as the thereto related logistics effort, that material and parts handling and the additional steps, such as the assembling of sub-elements can be economized.

By the controlled and central computer operated production of the composite shuttering panel elements, the documentation of the precursors used and the end product are also improved. The production statistics can be called up at any time and be monitored.

What is claimed:

1. Method for the continuous production of panel elements for the production of composite shuttering elements, of which each panel element comprises a shuttering panel of in each case predetermined geometry with predetermined length and the shuttering panel is equipped with fastening devices and reinforcement elements, the method comprising:

lining up a plurality of standard panels on a main conveyor line, each of the plurality of standard panels comprising, two opposite longitudinal edges;

joining and gluing the plurality of standard panels to one another with their longitudinal edges while applying a pressing force, so that a moved-forward panel band is created from the joined and glued-together standard panels;

separating individual longitudinal portions successively, so that individual panels with two side edges are generated that are opposite to each other transversely to the direction of movement of the panel band, wherein each individual panel has a length which is individually adapted to the respectively predetermined length of the shuttering panel to be produced;

clamping each individual panel, subsequently to separating, in an aligned manner on a transport pallet and conveying the panels on that transport pallet in a longitudinal direction in a lying position into and through a sequence of working stations along the main conveyor line in which working stations the individual panels are processed successively in a processing station by cutting the panels to the respective individual predetermined geometry of the respective shuttering panel, including generating intended apertures;

providing the shuttering panels successively in a fastening station with the fastening devices at predetermined locations and subsequently providing the shuttering panels in at least one fastening station with the reinforcement elements;

cutting one of two successively processed shuttering panels as an inner shuttering panel and the other one of the two successively processed shuttering panels as an outer shuttering panel depending on a condition that one side edge of the one individual panel is defined as a foot portion of the inner shuttering panel and that side edge of the other shuttering panel that is turned away from said one side edge, is defined as a foot portion of the outer shuttering panel; and conveying at an end of the conveyor line the two shuttering panels into a tilting station and erecting the associated transport pallets to an upright position by tilting these in mutually opposite tilting directions around their respective foot portion.

2. The method according to claim 1, further comprising:

feeding the standard panels in their longitudinal direction on a feeding conveyor system through an edge processing station prior to lining up the standard panels; and milling longitudinal grooves extending along one longitudinal edge of each standard panel and a longitudinal tongue on the other longitudinal edge of the standard panel while conveying each standard panel through the edge processing station.

3. The method according to claim 1, further comprising:

extracting the standard panels individually in an extracting station from a supply and conveying the standard panels successively in their longitudinal direction on a feeding conveyor system through a glue applying station;

applying glue to at least one of longitudinal edges of the standard panels conveyed through the glue applying station during their passage; and conveying the standard panels subsequently to applying glue transversely to their longitudinal direction into a pressing station in which the assembling and gluing of the standard panels is performed successively and in predetermined pressing steps.

4. The method according to claim 3, further comprising separating the individual panels from each other in a separating station following the pressing station, the separating being performed during one of the pressing steps that are performed in the separating station.

5. The method according to claim 4, further comprising labeling each individual panel in the separating station during that pressing step in which the separating is carried out, in a controlled manner in adaptation to a further processing of the individual panel.

6. The method according to claim 1, further comprising:

displacing one of two shuttering panels, which have been processed successively in the processing station, sidewards in a working station downstream of the fastening station in a direction that is turned away from the foot portion of this one shuttering panel;

positioning the other one of the two shuttering panels, at the latest in the tilting station, side by side with said one shuttering panel such that in the tilting station the foot portion of said one shuttering panel and the foot portion of the other shuttering panel are facing each other; and subsequently folding the two shuttering panels in the mutually opposite tilting directions.

7. The method according to claim 1, further comprising:

successively stacking the separated individual panels one upon the other from top to bottom in an intermediate stack prior to conveying the individual panels into the processing station; and extracting the individual panels successively from the intermediate stack from below and transferring these individual panels into the processing station.

8. The method according to claim 1, further comprising:

stacking the processed shuttering panels intermediately between the processing station and the fastening station in a buffer stack from bottom to top one below the other;

extracting the processed shuttering panels from the buffer stack from above; and transferring the shuttering panels into the fastening station.

9. The method according to claim 2, further comprising:

extracting the standard panels individually in an extracting station from a supply;

conveying the standard panels successively in their longitudinal direction on a feeding conveyor system through a glue applying station;

applying glue at least to one of their longitudinal edges while the standard panes re conveyed through the glue applying station; and subsequently conveying the standard panels that are provided with glue transversely to their longitudinal direction into a pressing station in which the assembling and gluing of the standard panels is performed successively and in predetermined pressing steps.

10. The method according claim 4, further comprising:

stacking the separated individual panels successively prior to conveying the individual panels into the processing station in an intermediate stack from top to bottom one upon the other;

extracting the individual panels successively from the intermediate stack from below; and transferring the individual panels into the processing station.

11. Method according to claim 4, further comprising:

stacking the processed shuttering panels intermediately between the processing station and the fastening station in a buffer stack from bottom to top one below the other; and extracting the individual panels from the buffer stack from above and transferring these individual panels into the fastening station.

* * * * *